United States Patent [19]

Tamaru et al.

[11] 4,283,782

[45] Aug. 11, 1981

[54] ALARM TIMEPIECE

[75] Inventors: Munetaka Tamaru; Minoru Natori, both of Tokyo, Japan

[73] Assignee: Citizen Watch Co., Ltd., Tokyo, Japan

[21] Appl. No.: 2,216

[22] Filed: Jan. 9, 1979

[30] Foreign Application Priority Data

Jan. 18, 1978 [JP] Japan ..... 53-4035
Feb. 25, 1978 [JP] Japan ..... 53-21214

[51] Int. Cl.[3] ..... G04B 23/02; G04B 19/04; G04C 21/16

[52] U.S. Cl. ..... 368/72; 368/228; 368/252

[58] Field of Search ..... 58/21.11, 21.14, 126 R, 58/127 R, 38, 57.5, 19 A, 19 B; 368/72–74, 223–225, 228

[56] References Cited

U.S. PATENT DOCUMENTS 2,806,910 9/1957 James ..... 58/19 A

*Primary Examiner*—Vit W. Miska
*Attorney, Agent, or Firm*—Birch, Stewart, Kolasch & Birch

[57] ABSTRACT

An alarm timepiece is disclosed having hand display means in which a plurality of alarm times may be set and the set times are displayed. A plurality of alarm time indexes are circumferentially arranged and rotatably provided for indicating the setting of the alarm time by angular position of the index. Further, alarm time memory means is provided to be co-operated with each index and alarm time detecting means is provided to be operated by the time measurement means of the timepiece. Each memory means, alarm time detecting means and an electric alarm device are connected by electric circuits to operate the alarm device when the alarm time detecting means operates to close the circuit.

8 Claims, 8 Drawing Figures

ALARM TIMEPIECE

BACKGROUND OF THE INVENTION

The present invention relates to an alarm timepiece in which a plurality of alarm times may be set.

In the conventional alarm clock or watch with the hand display means, only one alarm time may be set and the alarm time is not divided into A.M. and P.M. Therefore, the alarm device is operated twice at the set times of A.M. and P.M.

SUMMARY OF THE INVENTION

It is an object of the present invention to provide an alarm timepiece with hand display means in which a plurality of alarm times may be set and A.M. and P.M. alarm times may be separately set.

Further objects, features and advantages of the present invention will become apparent from the following description taken in conjunction with the accompanying drawings.

DESCRIPTION OF THE PREFERRED EMBODIMENTS

Figure 1:
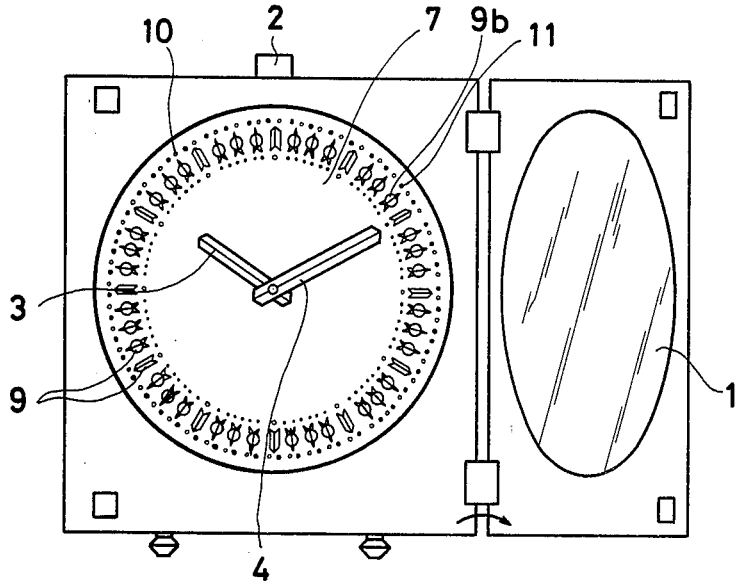
FIG. 1 is a front view showing a clock according to the present invention.

Referring to FIG. 1, the clock has a cover 1 with a glass, an alarm stopping button 2, an hour hand 3, and a minute hand 4. A plurality of indexes 9 for indicating time and alarm time are provided on a dial 7 at intervals of 15 minutes.

Figure 3:
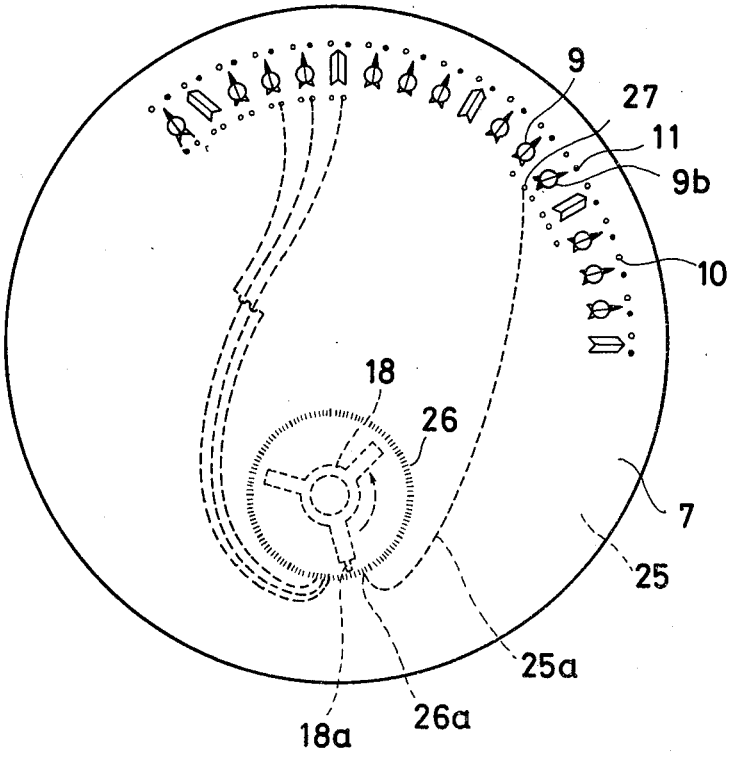
FIG. 3 is a front view showing a dial of the clock.
Figure 2:
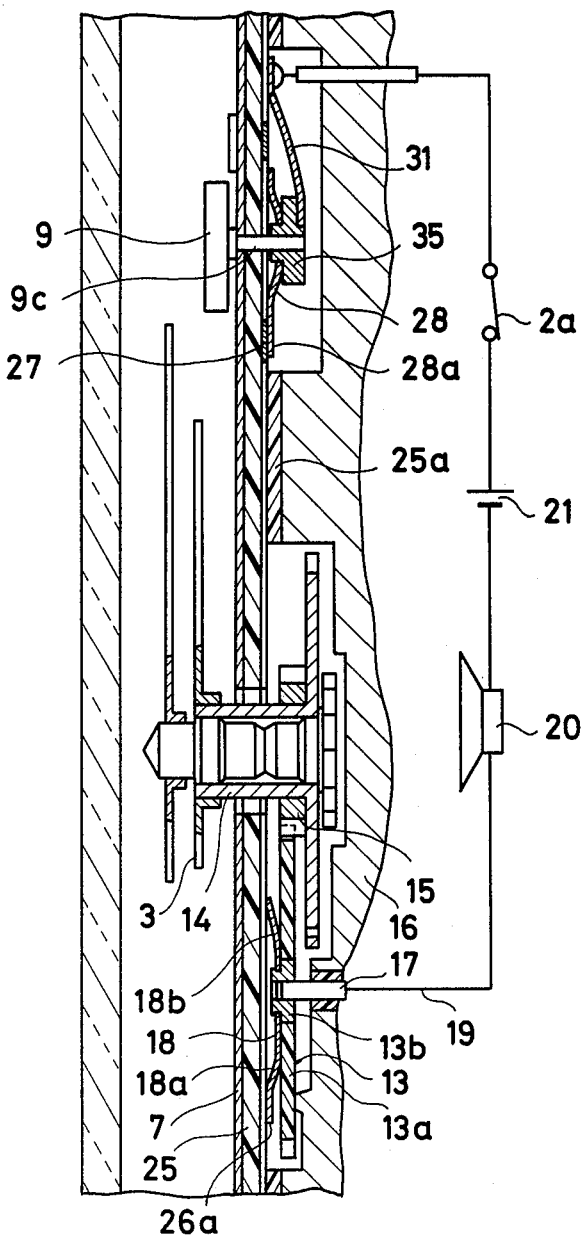
FIG. 2 is a sectional view of a part of the clock.

Referring to FIGS. 2 and 3, an alarm wheel or alarm time detecting wheel 13 is rotatably mounted on a shaft 17 which is secured to a base plate 16 with interposing an insulation tube. The alarm time detecting wheel 13 comprises a wheel 13*a* made of insulation and a hub portion 13*b* made of conductive material. The wheel 13*a* is engaged with a cannon pinion 15 which is secured to an hour wheel 14, so that the wheel 13*b* is rotated one turn per 24 hours. Secured to the hub portion 13*b* is a resilient brush 18 which comprises a contact blade 18*a* and a pair of short blades 18*b*. The blades 18*a* and 18*b* are slidably engaged with a print board 25 secured to the dial 7 and the contact blade 18*a* is adapted to engage with a terminal 26 of each lead lines 25*a* printed on the board 25 as shown in FIG. 3. The shaft 17 of the wheel 13 is connected to a battery 21 by a lead 19 through a buzzer 20 and the battery is in turn connected to a ring plate 31 through an alarm stop switch 2*a* actuated by the alarm stopping button 2.

Figure 4:
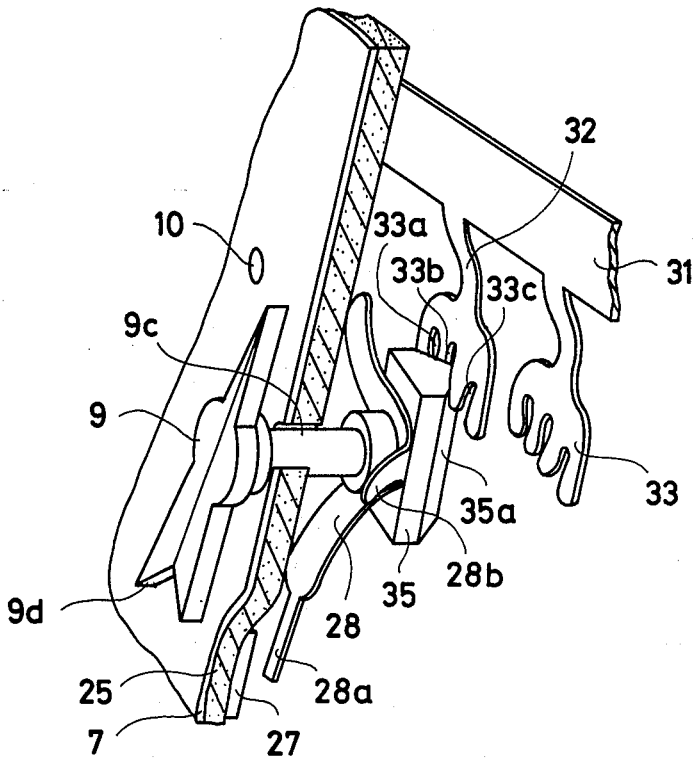
FIG. 4 is a perspective view showing an alarm setting device portion.
Figure 5:
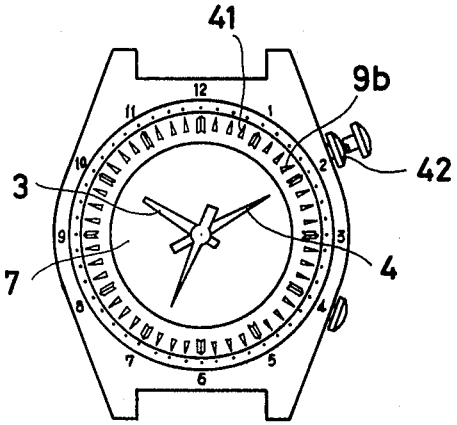
FIG. 5 is a front view of a wristwatch according to another embodiment of the present invention.
Figure 7:
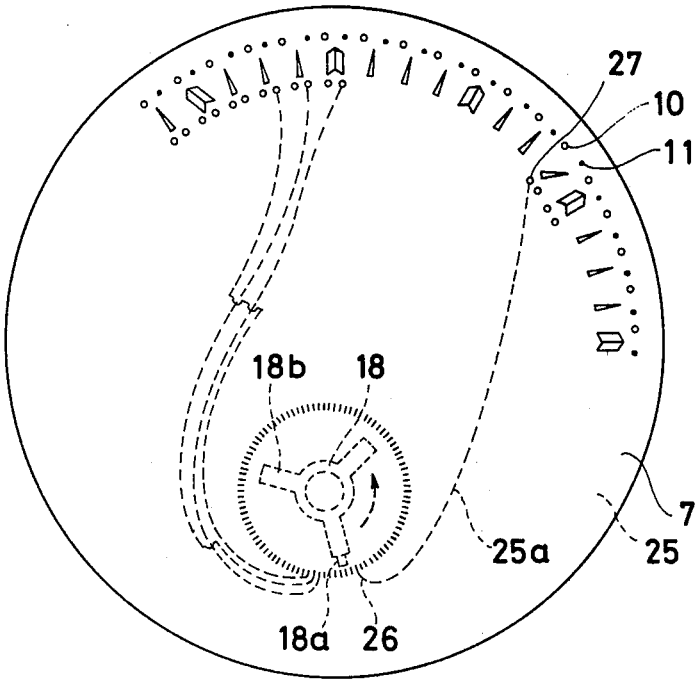
FIG. 7 is a front view showing a dial of the wristwatch.

Referring to FIG. 4, each of indexes 9 has a shaft 9*c* which is rotatably supported in the dial 7 and print board 25. Secured to the end of the shaft 9*c* are a resilient brush 28 and a click member 35. The resilient brush, which is similar to the resilient brush 18, comprises a contact blade 28*a* and a pair of short blades 28*b*. The contact blade 28*a* is adapted to engage with a terminal 27 for an A.M. provided on the board 25 and with a terminal for a P.M. (not shown). Each terminal is connected to each lead line 25*a*. Thus, lead lines 25*a* are provided for every A.M. and P.M. of the indexes 9 and terminals 26 are circumferentially arranged around the brush 28. The click member 35 has a tapered portion 35*a* which engages with one of notches provided in a positioning plate 33. The positioning plate is integrated with the ring plate 31 through a resilient portion 32. The notches of the positioning plate 33 comprises an A.M. positioning notch 33*a*, a neutral positioning notch 33*b* and a P.M. positioning notch 33*c*. The A.M. position is indicated on the dial 7 by mark "o" which is designated by numeral 10 and the P.M. position is indicated by a mark "·" designated by numeral 11 as shown in FIG. 3.

When the index 9 is in the neutral position, that is the index is positioned in the radial direction, the contact blade 28*a* of the brush 28 is not engaged with any terminals. Therefore, the alarm circuit is cut off, so that the buzzer 20 is not operated. To set the alarm time, for example to set the alarm time 1:45 P.M., the index 9*b* for 1:45 (FIGS. 1 and 3) is manually operated to rotate in the clockwise direction. Whereby, the index 9*b* is located in the P.M. position 11, at which the click member 35 engages with the P.M. notch 33*c* and the contact blade 28*a* engages with the terminal 27 of 1:45 P.M. The terminal 27 is connected to the terminal 26*a* by the lead line 25*a* corresponding to 1:45 P.M. When the brush 18 reaches the position of 1:45 P.M. the contact blade 18*a* engages with the terminal 26*a*. Thus the alarm circuit comprising the battery 21, buzzer 20, shaft 17, hub portion 13*b*, contact blade 18*a*, lead line 25*a*, contact blade 28*a*, click member 35, ring plate 31, and switch 2*a* is closed, so that the buzzer 20 is operated. If the switch 2*a* is cut off, the alarm operation stops.

It will be understood that it is possible to select a suitable alarm time interval other than 15 minutes of the embodiment and the interval at the contact terminal 26 may be reduced to a small minute than the minute interval on the dial, and that alarm setting indexes 9 may be provided on the cover of the clock and the brush 18 for detecting the set alarm time may be provided on other wheel than the alarm wheel 13.

Figure 6:
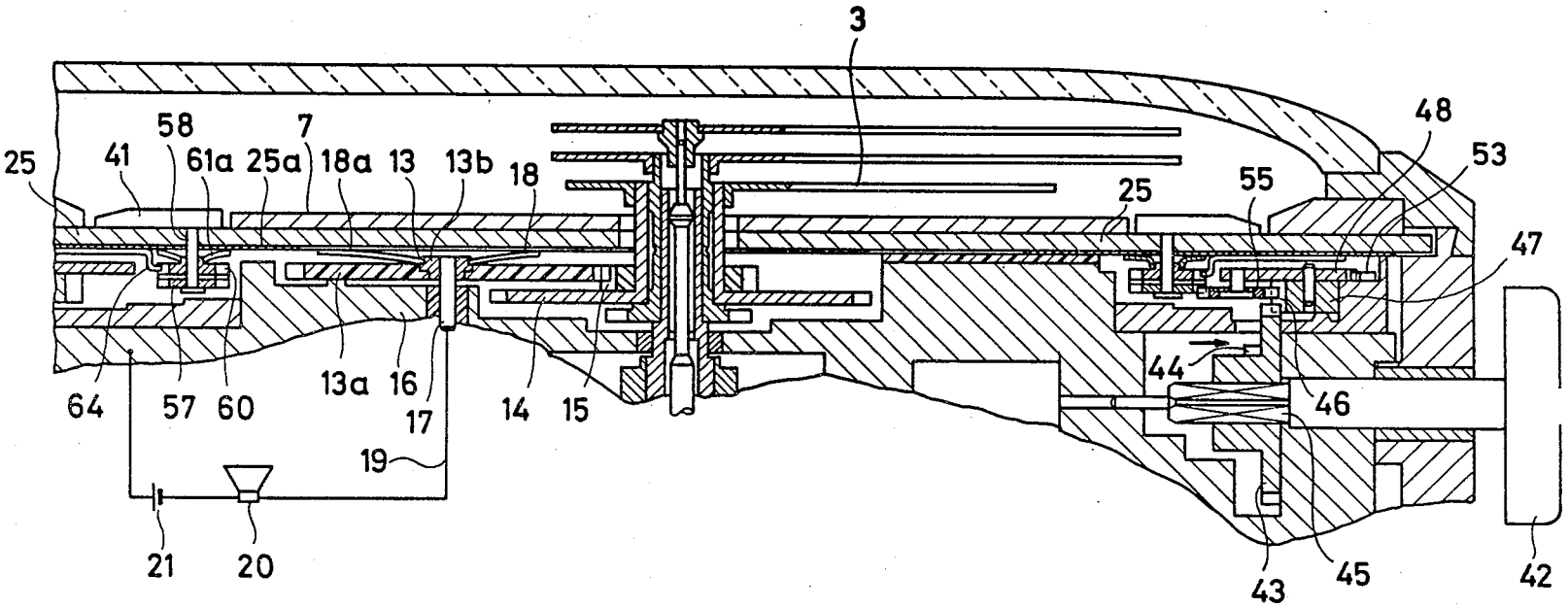
FIG. 6 is a sectional view of a part of the wristwatch.
Figure 8:
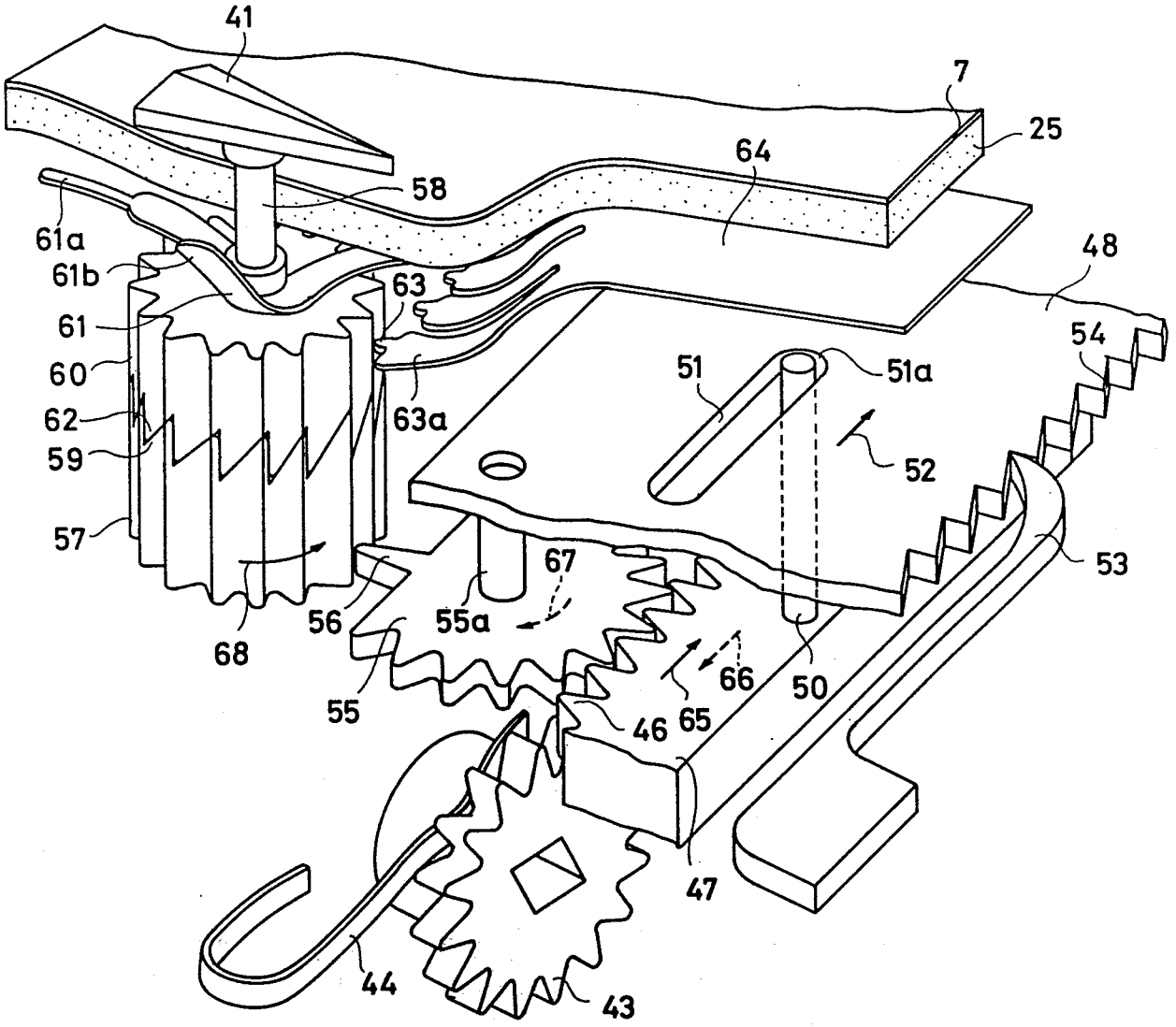
FIG. 8 is a perspective view showing an alarm setting device portion.

Referring to FIGS. 5 to 8 showing another embodiment, the present invention is applied to a wristwatch. The wristwatch is provided with a plurality of time indexes 41 similar to the indexes 9 of the previous embodiment. Each index 41 may be rotated by operating an alarm setting crown 42. The crown 42 is rotatably and axially slidably supported in the watch case adapted to be held in the pulled position and depressed position by a well known mechanism (not shown). On the stem of the crown 42 slidably engaged is a pinion 43 which is biased by a spring 44 toward a shoulder 45 of the stem. The pinion 43 is adapted to be engaged with a toothing 46 of a driving ring 47. In the depressed position of the crown, the pinion 43 is out of the engagement with the toothing 46. If the crown is pulled, the pinion is moved together with the shoulder 45 by biasing force of the spring 44, so that the pinion engages with the toothing 46 as shown in FIG. 6.

The driving ring 47 is coaxial with the center of the watch and slidably supported in the watch case. Above the driving ring, a ring 48 coaxial with the driving ring is rotatably supported in the watch case. Both the rings 47 and 48 is coupled with each other by engagement of a pin 50 secured to the ring 47 with an elongated perforation 51 of the ring 48. The ring 48 is permitted to rotate in the direction of arrow 52 and the reverse rotation is prevented by a pawl 53 engaged with a serration 54. On the ring 48, an alarm setting pinion 55 is rotatably mounted by a pin 55*a* and engaged with the toothing 46 of the ring 47. The setting pinion 55 has a projection 56 which is adapted to be engaged with a pinion 57 provided for each indexes 41. Each pinion 57 has a ratchet 59 at the end portion and is rotatably mounted on a shaft 58 of the index 41. On the shaft 58, a pinion 60 having a ratchet 62 is mounted to slide in the axial direction and a resilient brush 61 is secured to the pinion 60. The brush 61 comprises a contact blade 61*a* and a pair of short blades 61*b* as the brush 28 in the previous embodiment. Thus, the pinion 60 is urged to the pinion 57 by the brush 61 to be engaged with each other at the ratchets 59 and 62. The pinion 60 is engaged with a positioning projection 63 which is integrated with a ring 64 secured to the watch case. Other parts of the embodiment is same as the previous embodiment, therefore same numeral as previous one is used to identify the same part.

In operation, if the crown 42 is pulled out, the pinion 43 engages with the toothing 46 of the driving ring 47 as set forth above. If the crown is rotated in the clockwise direction, the pinion 43 rotates together with the stem of the crown. Therefore, the driving ring 47 is rotated in the direction of arrow 65, so that the pin 50 abuts on the end 51*a* of the perforation 51 to rotate the ring 48. Since the setting pinion 55 moves together with the ring 47, it does not rotate. When the projection 56 of the setting pinion 55 reaches one of indexs 41 and engages with the pinion 57, the pinion and hence the index 41 is rotated by a small angle because of slight engagement between the projection 56 and the pinion 57. When the projection 56 passes the pinion 57, the pinion returns to the neutral position by the resilient force of the positioning projection 63. Thus, the index 41 is swung slightly by the setting pinion 55, which informs the operator that the index is in the set enabling state.

When the setting pinion 55 reaches the index of alarm time to be set, the crown 42 is rotated in the counter clockwise direction. The driving ring 47 is rotated in the direction of arrow 66, so that the pin 50 moves along the slit 51, whereby the pinion 55 is rotated in the direction of arrow 67 to engage the pinion 57. The rotation of the pinion 55 cases the pinion 57 to rotate at least one revolution in the direction of arrow 68 with bending the positioning projection 63 at the resilient portion 63*a*, whereby the pinion 60 and hence the index 41 may be rotated. Thus, the index 41 may be set in the position of A.M. or P.M. and is held in the position by engagement of the positioning projection 63.

After the setting of the alarm time, the crown 42 is rotated in the clockwise direction, so that the driving ring 47 rotates solely untile the pin 50 engages with the end 51*a* of the slit 51, resulting the reverse rotation of the pinion 57. The pinion 60 is not reversely rotated with sliding the ratchet 62 on the ratchet 59. When the pin 50 abuts on the end of the slit 51, the pinion 55 reaches the position of FIG. 8. Other alarm time may be set in the same manner as above mentioned manner. Operation of the alarm time detecting wheel and alarm operating circuits are same as the previous embodiment.

It will be understood that if the resilient force of the portion 63*a* of the positioning projection 63 is increased or the regulating force of the pawl 53 is decreased, the ratchets 59 and 62 maybe omitted and the pinions 57 and 60 may be integrated with each other. As the modification of the device, the index 41 may be substituted with an electro-optical display means such as liquid crystal, light emitting diode or lamp. If the means by which position of the alarm setting pinion 55 may be observed is provided, for example if the position of the ring 48 may be indicated on the dial 7, it is not necessary to provide the device for swinging the index 41 by the setting pinion 55.

From the foregoing, it will be understood that the present invention may provide an alarm timepiece with the hand display means in which a plurality of alarm times may be set and displayed, and alarm time separated into A.M. and P.M. may be set.

While particular embodiments of the present invention have been illustrated and described herein, it is not intended to limit the invention to such a disclosure.

What is claimed is:

1. An alarm timepiece comprising:
a case having a dial face;
at least one time indicating hand;
time measurement means for generating a signal indicative of the time and for driving said at least one hand in response to said signal;
an alarm;
a plurality of time memory means, each of said time memory having a respective alarm time index rotatably mounted on a shaft, each of said time memory means for storing alarm energization information provided by the rotation of said shaft, said alarm energization information being stored in the time memory means corresponding to the time at which the alarm is to be energized, said respective alarm time index being rotated by said shaft to indicate the contents of its respective time memory means when said alarm energization information is stored, each of said time memory means having alarm energization information stored thereon energizing said alarm when the respective time said memory means is associated with is reached;
a manually operated crown positioned outside the case; and
alarm set means for transmitting the motion of said crown to a desired one of said respective alarm index shafts to provide said shaft with said alarm energization information.

2. The alarm timepiece of claim 1 wherein each of said time memory means includes
a first rotary brush fixed to said index shaft for storing said alarm energization information; and
wherein said timepiece further comprises:
a plurality of terminals each associated with a single time memory means; and
a second rotary brush driven by said time measurement means, said second rotary brush sequentially contacting said terminals to form an electric circuit with each terminal, said alarm being energized when said second rotary brush contacts a terminal associated with a time memory means having stored alarm energization information.

3. The alarm timepiece of claim 2 wherein said alarm set means indicates which time memory means it is associated with to allow the operator to visually align the alarm set means with the desired alarm index shaft.

4. The alarm timepiece of claim 3 wherein said crown is rotated in a first direction to align the alarm set means with the desired alarm index shaft and is rotated in a second direction opposite to the first direction to store said alarm energization information.

5. An alarm timepiece comprising:

a case having a 12 hr. dial face;

at least one time indicating hand;

time measurement means for generating a signal indicative of the time and for driving said at least one hand one revolution every 12 hours in response to said signal;

an alarm;

a plurality of time memory means, each of said time memory means having a respective alarm time index rotatably mounted on a shaft, each of said time memory means for storing alarm energization information provided by the rotation of said shaft, said alarm energization information including A.M. and P.M. information being stored in the time memory means corresponding to the time at which the alarm is to be energized, said respective alarm time index being rotated by said shaft to indicate the contents of its respective time memory means when said alarm energization information is stored, each of said time memory means having alarm energization information stored therein energizing said alarm when the respective time said memory means is associated with is reached, said shaft being rotated in a first direction to store A.M. alarm energization information and being rotated in a second direction to store P.M. alarm energization information.

6. The alarm timepiece of claim 5 wherein said crown is rotated in a first direction to align the alarm set means with the desired alarm index shaft and is rotated in a second direction opposite to the first direction to store said alarm energization information.

7. The alarm timepiece of claim 5 wherein each alarm time index may be rotated manually to store said alarm energization information.

8. The alarm timepiece according to claim 6 in which said alarm time indexes are circumferentially arranged around said dial force at intervals of predetermined minutes.

* * * * *